United States Patent [19]

Kober

[11] 4,305,550

[45] Dec. 15, 1981

[54] BATTERY-POWERED WIRE WRAPPING TOOL AND WRAPPING BIT

[75] Inventor: Marvin Kober, Spring Valley, N.Y.

[73] Assignee: O.K. Machine and Tool Corporation, New York, N.Y.

[21] Appl. No.: 189,088

[22] Filed: Sep. 22, 1980

Related U.S. Application Data

[60] Division of Ser. No. 761,768, Jan. 24, 1977, Pat. No. 4,194,700, which is a continuation-in-part of Ser. No. 679,519, Apr. 23, 1976, Pat. No. 4,064,581, and a continuation of Ser. No. 13,686, Feb. 21, 1979, abandoned.

[51] Int. Cl.[3] ..... B21F 15/00

[52] U.S. Cl. ..... 242/7.06; 242/7.17

[58] Field of Search ..... 242/7.06, 7.17, 7.18; 140/124; 7/107; 29/750, 751

[56] References Cited

U.S. PATENT DOCUMENTS

| | | | |
|---|---|---|---|
| 3,028,107 | 4/1962 | Hjorth | 242/7.17 |
| 3,077,211 | 2/1963 | Brooks | 242/7.06 |
| 3,244,202 | 4/1966 | Huang | 242/7.06 |
| 3,893,491 | 7/1975 | Jackson et al. | 140/124 |
| 3,994,320 | 11/1976 | Dorsey et al. | 242/7.17 |
| 4,111,242 | 9/1978 | Jacobson et al. | 140/124 |

*Primary Examiner*—Billy S. Taylor

[57] ABSTRACT

A portable battery-powered wire wrapping tool is described capable of using standard batteries. Battery contact is effected via a conductive cap, a conductive housing retaining ring, and a specially configured contact strip. A novel construction allows easy interchangeability of a spring loaded wrapping bit. A novel sleeve-less wrapping bit is also described which enables the production of modified wraps.

10 Claims, 7 Drawing Figures

BATTERY-POWERED WIRE WRAPPING TOOL AND WRAPPING BIT

This application is a continuation of my prior co-pending application, Ser. No. 13,686, filed Feb. 21, 1979, now abandoned, which in turn is a division of my prior co-pending application, Ser. No. 761,768, filed Jan. 24, 1977, now U.S. Pat. No. 4,194,700, which in turn is a continuation-in-part of application, Ser. No. 679,519, filed Apr. 23, 1976, now U.S. Pat. No. 4,064,581.

This invention relates to tools for wrapping wires onto electrical terminals, and more particularly to portable wire-wrapping tools and wrapping bits for use therein or separately.

Portable wire wrapping tools powered by batteries are known in the art. Such tools frequently are configured as guns, with the gun handle also serving as the battery compartment. There is a need in the art for inexpensive battery-powered portable wire-wrapping tools. To satisfy this need, plastic (synthetic resin) gun housings or casings have been employed. The electrical circuit which includes the tool motor, on-off switch and batteries is effected via a contact assembly-switch combination, actuable by the gun trigger, which establishes contact between the proximate battery positive terminal and one motor terminal. The connection between the other motor terminal and the remote battery casing which is its negative terminal (typically two series batteries are used) is effected via an elongated spring contact strip extending along a slot in the battery compartment wall. This construction requires the use of special, higher-priced, industrial-type batteries whose metal casing is partly uncovered at the side to allow an electrical connection to be made to the internal spring strip. Consumer type batteries, which are lower-priced, whose metal casings are completely enveloped by an insulating jacket along the sides, cannot be used in this known tool.

The known tool also employs a relatively expensive D.C. motor and a relatively expensive metal gear and clutch assembly for transmitting power to the rotatable bit driver (geared down to reduce speed and increase power) and also to provide slipping action if the bit jams to prevent motor overload and consequent damage. These expensive elements significantly contribute to the tool manufacturing cost.

In addition, it is desirable for such tools to provide a spring-loaded bit driver for preventing over-wrapping of a wire being wrapped around a terminal. In the known tool, this is accomplished by providing a back force spring behind the bit driver. The known tool also provides structure for receiving and fixing a sleeve member to the gun within which the wrapping bit is rotated. In the known tool, this is accomplished by means of a metal chuck adapted to be loosened and tightened for sleeve removal and replacement. Again, these relatively expensive elements significantly contribute to tool manufacturing cost.

In the referenced U.S. Pat. No. 4,064,281, a sleeveless wrapping bit is described and claimed, characterized by a simple and low cost construction. The bit is primarily intended to make normal wrapped connections (where only the bare stripped wire end is wound about the terminal). However, a modification is suggested for making modified wrapped connections (where the first few turns of the wrapped wire are of the insulation coated portion adjacent the stripped end). There is a need in the art for still a simpler bit construction capable of making a modified wrap, and which is also easier to use.

An object of the invention is a battery-powered portable wire-wrapping tool which can accommodate standard jacketed consumer-type batteries.

Another object of the invention is a battery-powered portable wire-wrapping tool capable of low-cost manufacture.

Still another object of the invention is a battery-operated portable wire-wrapping tool providing overload protection and spring-loading of readily-interchangeable sleeve-less bits which obviates the need for expensive gears, clutch mechanisms and chucks.

A further object of the invention is a novel wrapping bit construction capable of providng modified wraps.

These and further objects and advantages of the invention as will appear hereinafter are realized, briefly speaking, with a battery-operated portable wire-wrapping tool including one or more of the following features:

1. A battery compartment construction in the housing, primarily of low cost plastic, closed off by an electrically conductive end cap establishing electrical contact to the battery casing and to an internal contact strip by way of a metal retaining ring located to be contacted by the cap and in turn to contact the metal strip.

2. A novel power transmission from the motor shaft to the bit employing belt-driven pulleys offering a quieter, lower-cost construction with built-in slip to prevent motor overload.

3. A novel bit holding and driving construction providing back force spring-loading and easy bit removal and replacement while avoiding the use of costly chucks.

4. A novel wrapping bit construction characterized by an elongated flat on the bit shaft end on which is mounted a projecting sleeve, the flat extending rearward beyond the sleeve, providing a modified wrap and a window for observing the location of the inserted wire to facilitate use.

The invention will now be described in greater detail with reference to the accompanying drawings wherein.

Figure 1:
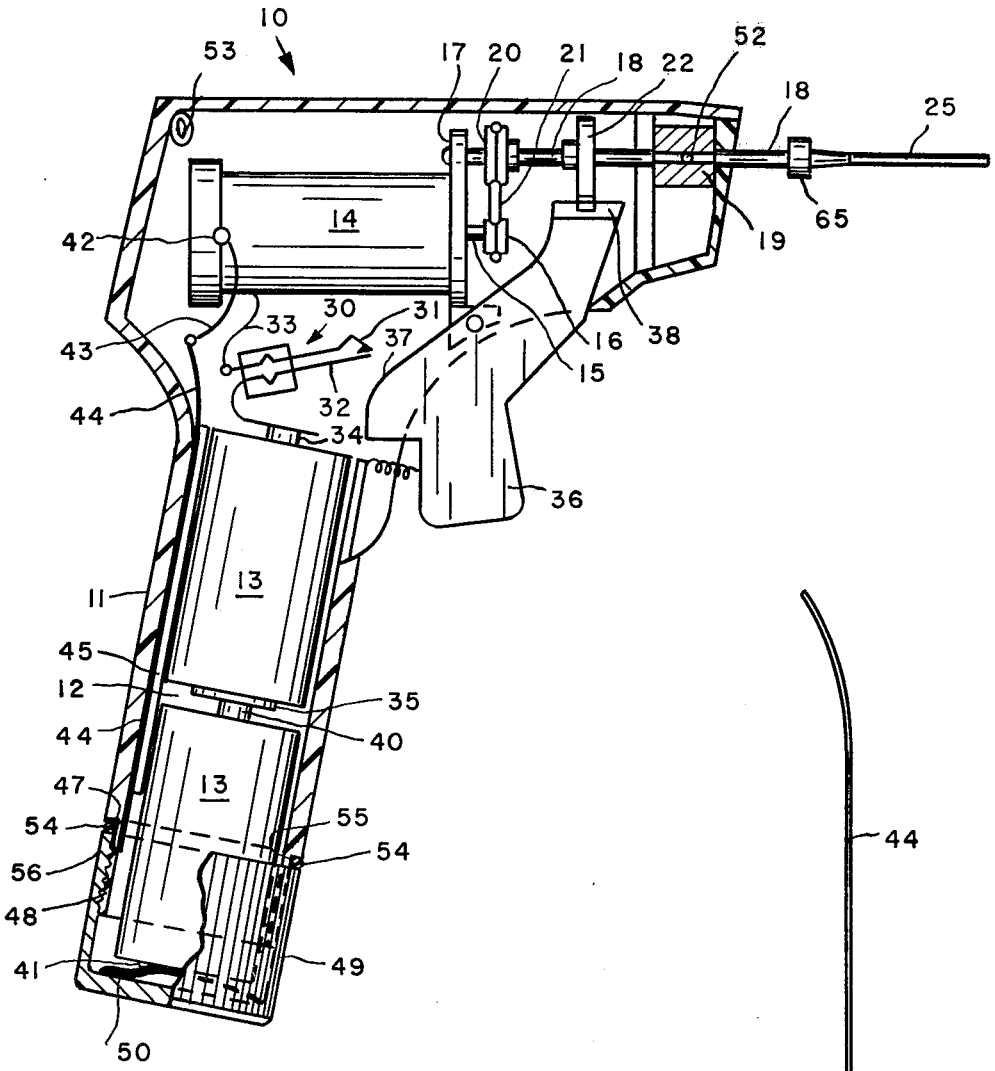
FIG. 1 is an elevational, partly cross-sectional view of one form of wire-wrapping tool in accordance with the invention with the side removed to show the interior construction.

FIG. 1 illustrates a preferred embodiment of the tool of the invention with part of the casing removed to show the interior construction. A gun-shaped housing 10 is illustrated, with a handle 11 also serving as a battery compartment 12 for two series-connected batteries 13. Within the housing 10 is mounted a D.C. motor 14 on whose shaft 15 is mounted a small pulley 16. The motor frame includes a bearing 17 for a shaft 18 which rotates within a bearing 19, for example of nylon, which is secured as with screws to the housing 10. On the shaft 19 is secured a larger pulley 20. A belt 21 connects the smaller motor-driven pulley 16 to the larger pulley 20 to provide speed reduction. The belt 21 is conveniently constituted by a rubber O-ring. A cam-stop member 22 is also secured to the shaft 19. The shaft 18 extends from the housing 10 and a wire-wrapping bit 25 is secured to the shaft to rotate therewith.

To maintain costs low, the housing 10 including the battery compartment 11 is preferably constituted of a synthetic resin. Electrical connection to the motor is accomplished as follows. A contact-switch assembly 30 is mounted on an insulating block secured to the housing. The assembly includes a pair of spaced spring-metal contact strips 31, 32, of which the upper one is wired 33 to one motor terminal (not shown). The lower contact strip 32 has a bottom portion bent around to be contacted by the positive terminal 34 of the upper battery 13, whose negative terminal 35 is shown at the bottom. The battery may be a standard "C" cell with an insulating jacket, and thus its casing, the negative terminal, is only accessible at the bottom at 35. A spring-loaded trigger 36 is pivotably mounted on the housing 10. When the trigger 36 is depressed a camming portion 37 engages the lower contact strip 32, causing contact with the upper contact strip 33, completing the circuit from the positive battery terminal 34 to the one motor terminal. Simultaneously, the upper end 38 of the trigger 36 is displaced from the path of the stop 22, allowing the shaft 18 to be rotated. When the trigger is released, the motor is deactivated and the upper end 38 of the trigger reengages the stop 22 immediately stopping all rotary motion.

Figure 2:
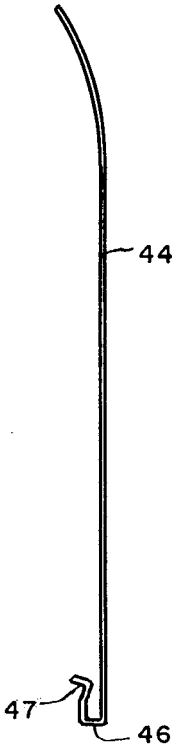
FIG. 2 is an elevational view of the contact strip employed in the tool of FIG. 1.

The upper battery negative terminal 35 contacts the lower battery upper positive terminal 40. Its lower negative terminal is shown at 41. The other motor terminal 42 is wired 43 to one end of an elongated contact strip 44, also shown separately in FIG. 2. The contact strip 44 extends within a slot 45 in the battery compartment wall, and its lower end is bent under and outward to form a U 46, with the free end of the U provided with a recess 47. The U bight passes through a transverse wall slot to the housing exterior, just above a threaded portion 48 for receiving a threaded removable end cap 49 by which access is had to the battery compartment 12 for removing and introducing batteries. The cap 49 has at its bottom on its interior a spring metal contact 50 which contacts the battery negative terminal 41. The cap 49 has an electrically conductive surface. It can be constituted of metal, or, preferably, of a metallized synthetic resin. The spring metal contact 50 thus establishes a connection to the cap surface.

The housing 10 is typically made in two halves, held together by suitable fasteners. In the illustrated embodiment, the nozzle end of the housing is conveniently held together by screwing each half of the housing to the shaft bearing 19. One of the screw holes is shown at 52. The left upper end of the housing is conveniently held together by a screw passing through a hole 53 provided therein. The handle end halves are conveniently held together by means of a split retaining ring 54 which encircles the handle and is located in an annular groove 55 on the housing. In accordance with a feature of the invention, the retaining ring 54 is electrically conductive. For example, it may be of metal. Further, the recessed end 47 of the negative terminal contact strip 44 extends into the groove 55, with the result that the retaining ring 54 is maintained in good electrical contact with the contact strip 44. After the batteries 13 have been introduced, the cap 49 is screwed on. Its height is such that its electrically conductive rim 56 engages the retaining ring 54, with the result that the electrical circuit from the battery negative terminal 41 to the contact strip 44 is completed via the cap metal contact 50, the conductive cap 49 itself, and the conductive retaining ring 54.

As will be observed from the foregoing description, a relatively simple, low weight, low cost, battery-operated wrapping tool is obtained in accordance with the invention. Ordinary, low-cost (for example, type C), consumer type batteries, regular or rechargeable, can be employed, which do not require removal of the insulating jacket along the sides to enable contact to be made to the battery negative terminal. By using the housing retaining ring 54 to establish the desired electrical connection, the tool assembly is greatly simplified. The use of low cost pulleys and an O-ring belt in place of expensive gearing also reduces costs and enables the substitution of a lower power, less expensive driving motor. Expensive clutch assemblies are also eliminated, since the pulley system is capable of providing built-in slippage in case the bit jams. A sleeve-less wrapping bit of the type described in my U.S. Pat. No. 4,064,581, can be employed with the tool of FIG. 1. All that needs to be done is to couple the wrapping bit, separated from its handle, to the rotary shaft 18.

Figure 3:
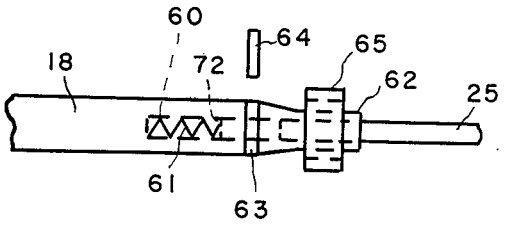
FIG. 3 is a fragmentary view illustrating mounting of a wrapping bit on the tool of FIG. 1.
Figure 7:
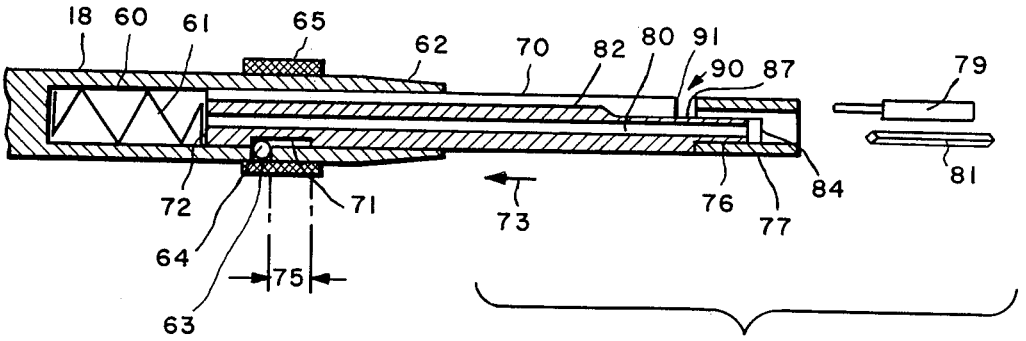
FIG. 7 is an enlarged, cross-sectional, side view of the bit of FIG. 5 shown mounted on the tool of FIG. 1.

In accordance with a further feature of the invention, a novel coupling of the wrapping bit 25 to the driven shaft 18 which also provides a spring-loaded backing force for the bit is also provided. This is illustrated in FIGS. 3 and 7.

The shaft 18 projects from the gun nozzle. The shaft 18 is provided with a blind hole 60 which receives a compression spring 61 which provides the desired back force. The shaft 18 is slightly tapered inward at its end, shown at 62. Extending transverse to the shaft axis is a slot 63, which penetrates through to the hole 60. The slot 63 is adapted to receive a small pin 64. A resilient sleeve 65, for example of nylon, is provided. The sleeve 65 is dimensioned to form a tight fit over the shaft 18 and serves to retain the pin 64 in the slot 63. The sleeve 65 in its retaining position is shown in FIG. 7. By sliding the sleeve to the right in FIG. 7, onto the tapered section 62 as shown in FIG. 3, the pin 64 can be removed.

Figure 4:
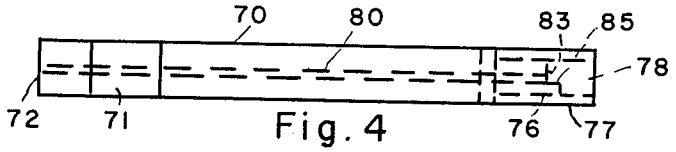
FIG. 4 is a top plan view of one form of wrapping bit in accordance with the invention.
Figure 5:
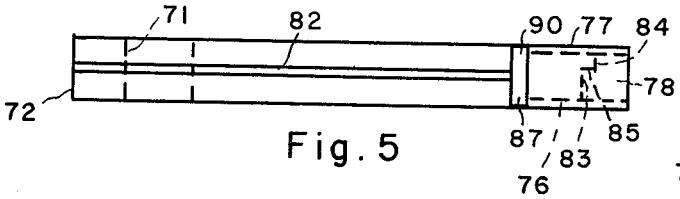
FIG. 5 is a bottom plan view of the bit of FIG. 4.
Figure 6:
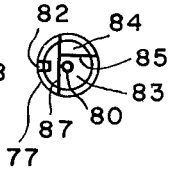
FIG. 6 is an end view of the wrapping face of the bit of FIG. 5.

A novel wrapping bit is illustrated in FIGS. 4–6. It comprises an elongated shaft 70 provided at its side near one end 72 with a recessed wide slot 71. The shaft 70 diameter is chosen to be received by the hole 60 in the gun driven shaft 18. The bit 70 is secured to the gun driven shaft 18 by inserting the end 72 into the hole 60, which contains the spring 61, and urging the bit shaft 70 inward against the spring 61 force until the bit slot 71 is aligned with the shaft through-slot 63, then the pin 64 is inserted in slot 63, and sleeve 65 positioned as shown in FIG. 7 to cover and retain the pin in both slots. The pin 64 locks the bit shaft 70 to the gun shaft 18 whereby rotation of the latter carries with it the wrapping bit 70. As will be observed, the bit 70 can be displaced to the left in FIG. 7, shown by the arrow 73, against the spring 61 force a distance equal to the width of the wide slot 71 less the pin 64 diameter, which is shown at 75 in FIG. 7. This provides the desired back force on the wrapping bit which prevents overwrapping of the wire on the terminal, as the bit 70 can be displaced inward should the tool not be withdrawn as fast as the wire winds on the terminal. The construction described also provides, as is evident, for ready replacement of the bit 70 by reversing the assembly procedure.

The novel wrapping bit illustrated also enables making of a modified wrap, wherein the first few coil turns are of the insulated wire. This is achieved in accordance with a further feature of the invention by providing a sleeve-less wrapping bit similar to that described in said copending application, Ser. No. 679,519, but with a modified working end for producing the modified wrap. Similar to what is described in the copending application, the bit shaft end is provided with a reduced diameter section 76 on which is permanently secured a cylindrical sleeve 77 so as to project beyond the shaft end forming a recessed area 78 within which the wrapping occurs, which also assists in prevent overwrapping or pile-up of turns. The working end face contains a center bore 80 for receiving a terminal 81 on which the wire is to be wrapped. The stripped wire end 79 is received in a hole formed by a groove 82 running lengthwise along the shaft surface. The wrapping face is formed by axially-spaced lands 83, 84 separated by a wall 85 extending transverse across the end face. The land 83 is at the lower level where the terminal bore 80 terminates, and the land 84 projects forwardly to form the wall 85, which serves to wipe down the wire end. The land 83 is readily formed by milling a flat across the end face before the sleeve 77 is pressed on. Another flat 87 is milled across the shaft end also before the sleeve 77 is pressed on. This flat is in a plane parallel to the axis and at right angles to the wall 85. The flat 87 has a depth greater than that of the groove 82, and such that a space is formed within the fixed sleeve 77 that will accommodate the insulation-coated portion of the wire 79. It will further be observed that the flat extends along the shaft end beyond the end of the sleeve 77 forming a window 90 exposing the flat 87.

In the operation of the bit of the copending application, the groove for the stripped wire end and the terminal-receiving bore are at the same level. When the tool is rotated, only the stripped end in the groove is wound about the terminal. In the construction described in the present application, the flat 87 provides an enlarged space into which the insulated wire end will pass and can be recessed below the level of the bore 80 opening. The window 90 allows the user to see the stripped wire end and direct it into the groove 82, which however will not accommodate the insulated wire, which is stopped by the flat shoulder 91. Now, when the bit is rotated, the first few turns of the coil are formed by the insulated portion of the wire lying in the window 90, thus forming the modified wrap desired.

It will be understood that the tool of the invention illustrated in FIG. 1 can also be used with known wrapping bits of different end face configurations, provided that their shafts are formed with the slot 71 for receiving the pin 64 for attaching the bit to the tool.

It will also be understood that the bit 70 with the novel working end to provide a modified bit need not be limited to use with the tool of FIG. 1, but can also be used separately. For instance, it can be used to replace the wrapping bit end of the hand tool described in the said opening application, in which case the mounting slot 71 would be unnecessary. Or, it could be used with a different kind of power tool, such as a pneumatically-driven power tool.

In addition, the features of the belt drive and bit mounting and bit itself are not limited in their use to battery-operated tools. Such features can also be incorporated in an electrically powered tool. For instance, a transformer and rectifier circuit can be provided which when powered by AC line voltage supplies an output voltage stepped down and converted to 3 volts DC, which can then be used to activate the tool motor through trigger-actuated contacts or a microswitch. If desired, the transformer can be provided separately and connected by a flexible electric cord to the tool handle.

The constructions described are useful to wrap wires of the usual sizes employed in the electronic and telephone industries, a #30 gauge wire being typical.

While my invention has been described in connection with specific embodiments thereof, those skilled in the art will recognize that various modifications are possible within the principles enunciated herein and thus the present invention is not to be limited to the specific embodiments disclosed.

I claim:

1. A wire wrapping tool comprising a bit driver, means for rotating the bit driver, a wire wrapping bit having a longitudinal direction and having a first end for receiving a terminal and a wire and when rotated wrapping the wire around the terminal and a second end for mounting onto the bit driver, said bit driver having a hole for receiving the bit second end, spring means in the hole for providing a longitudinal force on the bit when the latter is inserted in the driver hole, and means under user control for releasably securing the bit second end to the driver and to enable limited longitudinal movement of the bit against the spring force during operation, said driver hole extending in the longitudinal bit direction and the driver wall defining the driver hole having a slot extending transverse to the longitudinal direction intercepting its hole, the bit second end having a slot, the releasably securing means comprising a user removable pin configured to be received by both the driver wall slot and the bit slot and when so engaging both slots extending transverse to the longitudinal bit direction and coupling the driver and bit together, the bit slot being wider in the longitudinal direction than the pin enabling longitudinal movement of the bit against the spring force exerted by the spring means, and removable pin retaining means comprising a resilient sleeve slideably mounted on the bit driver.

2. A wire wrapping tool as claimed in claim 1, wherein the bit driver is tapered adjacent its slot.

3. A wire wrapping tool comprising a bit driver, means for rotating the bit driver, a wire wrapping bit having a longitudinal direction and having a first end for receiving a terminal and a wire and when rotated wrapping the wire around the terminal and a second end for mounting onto the bit driver, said bit driver having a hole for receiving the bit second end, spring means in the hole for providing a longitudinal force on the bit when the latter is inserted in the driver hole, and means under user control for releasably securing the bit second end to the driver and to enable limited longitudinal movement of the bit against the spring force during operation, the driver hole extending in the longitudinal bit direction and the driver wall defining the hole having a slot extending transverse to the longitudinal direction and intercepting its hole, the bit second end having a slot along its side which is wider than the driver slot, the releasably securing means comprising a user removable pin configured to be loosely received by both the driver slot and the bit slot and when so received coupling the driver and bit together, and user removable means externally slideably mounted on the bit driver so as to enclose and retain the pin in both slots.

4. A wire wrapping bit comprising an elongated shaft, said shaft end having a bore for receiving a terminal, means in the shaft end forming a hole extending parallel to the bore and spaced therefrom for receiving a bare wire end, a sleeve fixed to the shaft end and projecting forwardly at the shaft end forming a recessed area in which the bore terminates, means on the shaft end providing an enlarged area aligned with the wire end receiving hole for receiving the insulated portion of the wire adjacent its bare end and including a grooved shoulder portion bordering the enlarged area interior for stopping the insulated portion of the wire but allowing the bare wire end to pass into the groove, and means on the shaft end providing a side window spaced from the shaft end and adjacent the grooved shoulder portion for observing the wire insulation adjacent the bare end when the latter is inserted in the hole.

5. A wire wrapping bit as claimed in claim 4, wherein the enlarged area is provided by a flat on the shaft end and extending in a plane parallel to the shaft axis, said sleeve encircling the forward part of said flat leaving exposed by means of said window a rearward part of said flat, said hole terminating adjacent the exposed rearward part of said flat.

6. A wire wrapping bit as claimed in claim 5, wherein the sleeve is mounted on a reduced diameter end of the shaft, and means are formed on the shaft end within the sleeve for wiping down the wire end, said last-named means comprising axially-spaced lands forming a single transverse wall.

7. A wire wrapping bit as claimed in claim 5, wherein a slot transverse to the longitudinal direction is provided on the shaft remote from the sleeve for use in coupling the bit to a wire-wrapping tool.

8. A wire wrapping bit as claimed in claim 5 wherein the flat has a greater depth than the groove in the shoulder portion.

9. A wire wrapping bit for making a modified wrap comprising an elongated shaft having an axis, the forward end of the shaft having a bore for receiving a terminal and having a flat extending in a plane parallel to the shaft axis and spaced from the bore, a cylindrical sleeve fixed to the shaft end and projecting forwardly at the shaft end and encircling the forward part of the flat forming with the flat an enlarged area extending parallel to the bore and spaced therefrom for receiving an insulated wire end, said sleeve forward end enclosing a recessed area in which the bore terminates, and means on the shaft terminating at said enlarged area and dimensioned for receiving a bare portion of the wire adjacent its insulated end but not the insulated end itself, the rearward part of the flat being exposed to form a side window for observing the wire insulation adjacent the bare end when the latter is inserted through the enlarged area into its receiving means.

10. A wire wrapping bit as claimed in claim 9, wherein the bare wire receiving means is formed by an axially extending groove along the side of the shaft, said groove depth being shallower than the depth of the flat.

* * * * *